United States Patent [19]

Morgan

[11] Patent Number: 4,753,613

[45] Date of Patent: Jun. 28, 1988

[54] ELECTRICAL CONTACT MODULE AND HOUSING

[75] Inventor: David D. Morgan, Merthyr Tydfil, Wales

[73] Assignee: AB Electronics Component Limited, Great Britain

[21] Appl. No.: 810,378

[22] Filed: Dec. 18, 1985

[51] Int. Cl.[4] ..... H01R 13/514

[52] U.S. Cl. ..... 439/701; 439/291; 439/552; 439/752

[58] Field of Search ..... 339/192 R, 192 RL, 211, 339/206 R, 206 P, 196 R, 196 M, 191 R, 191 M, 210 R, 210 M, 198 G, 184 M, 128, 217 S, 217 R, 217 PS, 198 H, 196 A, 176 M, 214 R, 214 S; 439/701, 291, 552

[56] References Cited

U.S. PATENT DOCUMENTS

| | | | |
|---|---|---|---|
| 2,545,429 | 3/1951 | Macy | 439/718 |
| 3,011,143 | 11/1961 | Dean | 339/211 |
| 3,942,860 | 3/1976 | McDonough | 339/217 S |
| 4,005,925 | 2/1977 | Sudre | 339/198 H |
| 4,050,757 | 9/1977 | Glaesel | 339/217 S |
| 4,124,264 | 11/1978 | Kato et al. | 339/217 S |
| 4,245,875 | 1/1981 | Shaffer et al. | 339/184 M |
| 4,455,056 | 6/1984 | Herrman, Jr. et al. | 339/211 |
| 4,477,142 | 10/1984 | Cooper et al. | 339/128 |
| 4,560,227 | 12/1985 | Bulcala | 339/198 H |

FOREIGN PATENT DOCUMENTS

| | | | |
|---|---|---|---|
| 2519551 | 11/1975 | Fed. Rep. of Germany | 339/198 H |
| 2135728 | 9/1979 | Fed. Rep. of Germany | 339/198 H |
| 2269801 | 5/1974 | France . | |
| 2347797 | 11/1977 | France . | |
| 0416785 | 1/1967 | Switzerland | 339/196 M |
| 1503505 | 3/1978 | United Kingdom . | |

OTHER PUBLICATIONS

IBM Technical Disclosure Bulletin, vol. 14, No. 9, Feb. 1972, E. C. Uberbacher, Electrical Connector Assembly, p. 2843.

*Primary Examiner*—Neil Abrams

*Attorney, Agent, or Firm*—Saidman, Sterne, Kessler & Goldstein

[57] ABSTRACT

In order to provide a modular housing system for electrical contacts whereby contact banks of required size may be made up from common or modular parts, a contact module comprises a body 22 adapted to be slidably received and located in a housing 21, and at least one contact 32, 33 received in an individual groove 24 in the body 22 so as to project from the body 22. The contact 32, 33 has a configuration 37 co-operable with a corresponding formation 27 in the groove 24 to prevent longitudinal movement of the contact 32, 33 in the groove 24. As illustrated, the configuration is a slot 37 formed in part of the contact to locate on a corresponding abutment 27 in the groove 24. The slot 37 is received by an undercut in the abutment 27 to inhibit lateral movement of the contact 32, 33. In use, the contact modules 22 will be slid individually and in close contact into a housing 21, so that movement of the contact out of the grooves will be prevented, either by the housing itself or, in most cases, by the adjacent contact module body. By having the contact modules individually slidable and locatable in the housing, the individual contacts may be accessed, e.g. for changing, if required, without disturbing the adjacent contacts.

1 Claim, 5 Drawing Sheets

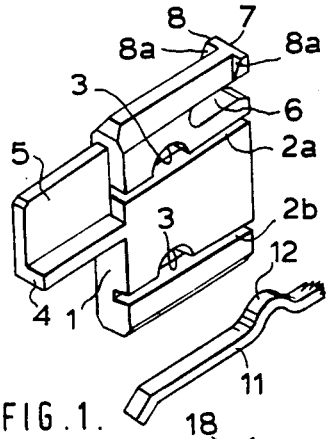
FIG. 1.
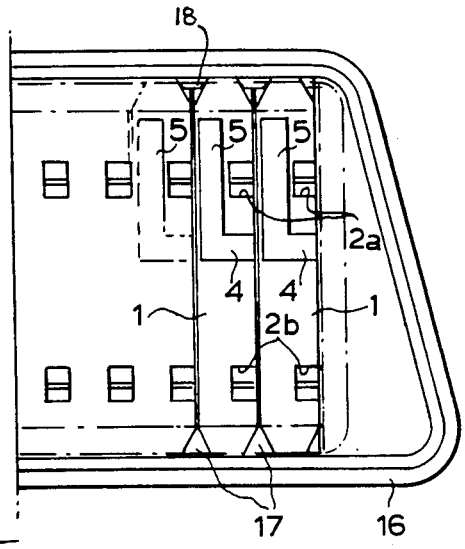
FIG. 3.
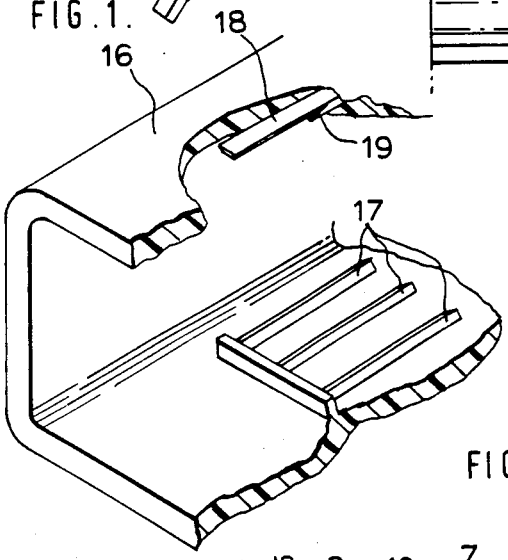
FIG. 2.
FIG. 4.
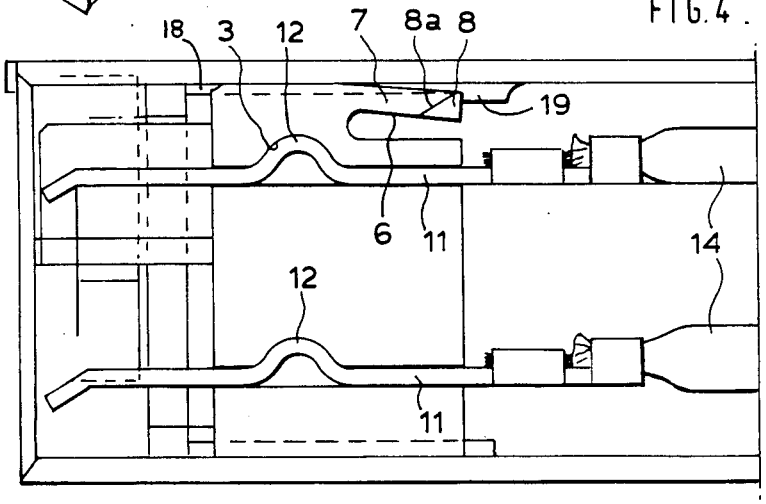

FIG. 5.
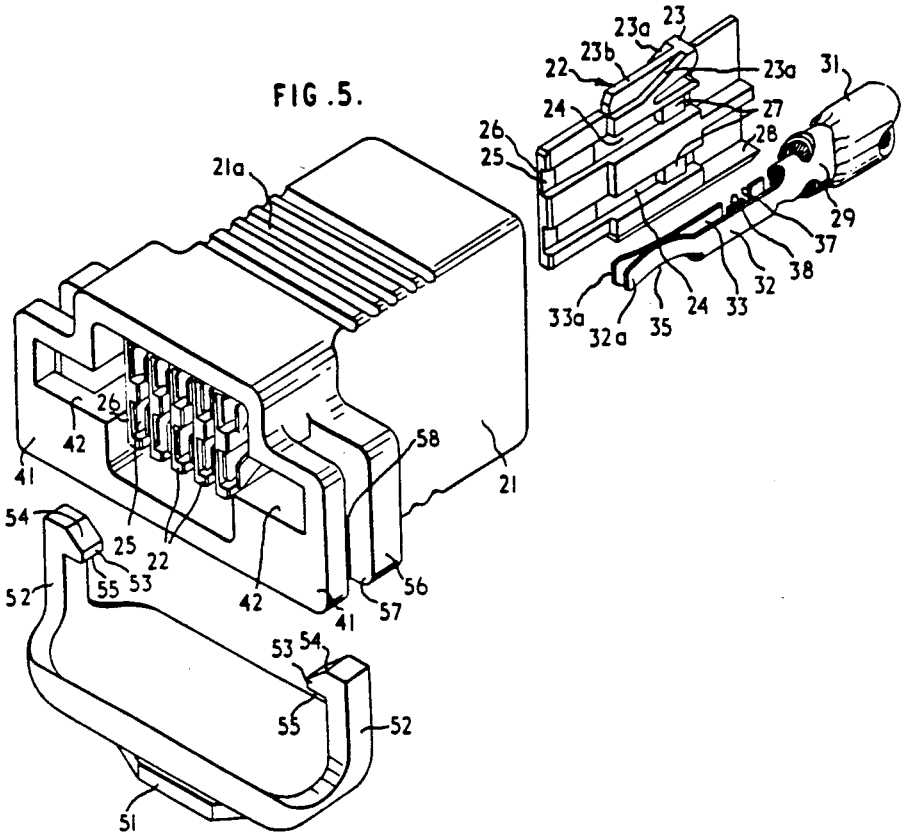
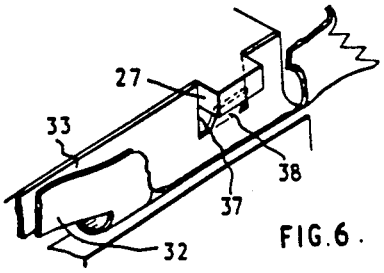
FIG. 6.

ELECTRICAL CONTACT MODULE AND HOUSING

INTRODUCTION

This invention relates to housings for electrical contacts.

REVIEW OF PRIOR ART

In GB-A-No. 1121742 there is described and illustrated a form of electrical coupler for multi-conducting cables in which the individual contacts are located in contact modules which are built up into an assembly which is then inserted as a whole into a housing. In such an arrangement, it is not possible to remove any one contact module individually from the housing.

Also, the distal ends of the contacts protrude from their contact modules, which leads to a considerable risk of damage.

SUMMARY OF THE INVENTION

It is an object of the invention to provide a contact module for a modular housing system for electrical contacts whereby contact banks of required size may be made up from common or modular parts which may be individually inserted into and removed from a housing for the whole bank.

In accordance with a first aspect of the invention there is provided a contact module comprising a body adapted to be individually slidably received and located in a housing in close lateral proximity to other similar bodies, and at least one contact received or receivable in an individual groove in the body so as to project from the body at one end to make an external connection and having a distal end for co-operation with a further contact, the contact having a configuration co-operable with a corresponding formation in the groove to prevent longitudinal movement of the contact in the groove.

The configuration may be an offset received in a corresponding extension of the groove.

In an alternative, the configuration may be a slot formed in part of the contact to locate on a corresponding abutment in the groove. The slot may be associated with a resilient tongue adapted to engage the abutment to inhibit lateral movement of the contact. Alternatively, the abutment may be provided with an undercut which receives and co-operates with the contact in the region of the slot to inhibit lateral movement of the contact.

In use, the contact modules will be slid individually and in close contact into a housing, so that movement of the contact out of the grooves will be prevented, either by the housing itself or, in most cases, by the adjacent contact module body. By having the contact modules individually slidable and locatable in the housing, the individual contacts may be accessed, e.g. for changing, if required, without disturbing the adjacent contacts.

The use of a modular arrangement enables the user to use any of a variety of arrangements, and in particular, if a high current contact, with correspondingly high heat dissipation requirements, is used in a housing with low current contacts, adjacent contact grooves may be left vacant.

It is preferred that the bodies shall each have a portion deflectable so as to snap fit into the housing, and also so as to be releasable from the snap fit when required.

It is also preferred that the distal ends of the contacts should not protrude beyond the ends of their respective grooves. Preferably the contacts are hermaphroditic.

In one arrangement, where there are two contacts housed in a common module or body, the contacts may be isolated from each other by a wall which is offset towards one of the contacts.

By such an arrangment the bodies are made usable with either male or female housings, being inserted one way up in the male housings and the reverse way up in the female housings. Similarly, one contact of two in the body may be isolated from one adjacent contact by means of a further wall located in a position offset from the median plane of the body.

Alternatively, the contacts may be isolated from the contacts of adjacent modules by a laterally offset wall, which avoids the necessity for inverting the modules in male and female housings.

The contacts themselves may be formed of two spring leaves diverging away from a zone of resilient contact so that the zone of resilient contact may receive one of the leaves of a similar contact directed towards it. The contacts are thus hermaphroditic.

In accordance with a second aspect of the invention there is provided a contact housing including a plurality of modules in accordance with the invention as set forth above, located side by side within the housing.

As indicated above, the housings may be made in two co-operating male and female forms, and means may be provided on the co-operating ends of the housings to prevent incorrect matching of two housings.

Preferably, a contact housing has lateral extensions for cooperating with means for attachment of the housing to a mounting panel.

The mounting means may comprise a spring clip, engageable by spring clip connection both with one of the lateral extensions and with the panel.

The clip may include means for mechanical engagement with the panel to restrain the housing against axial movement which might overstrain the spring clip connection with the panel.

In accordance with a third aspect of the invention, there is provided a contact connector comprising two co-operating housings according to the invention as set forth above, the housings being in male and female forms.

Means may be provided on the cooperating ends of the housing to prevent incorrect matching of two housings.

BRIEF DESCRIPTION OF THE DRAWINGS

The invention will be further described with reference to the accompanying drawings, which illustrate two embodiments of the invention, and in which:

FIG. 1 shows side by side perspective views of a modular body and a co-operating part of a contact in a first embodiment of the invention;

FIG. 2 is a perspective cut away view showing part of a housing;

FIG. 3 is an elevation showing part of a housing with a number of modules in position therein;

FIG. 4 is a sectional view through the housing of FIG. 3;

FIG. 5 is an exploded view of a female housing including modular bodies and one contact, illustrating a modified form of embodiment;

FIG. 6 is a perspective view to an enlarged scale showing some details of the contact and body;

DETAILED DESCRIPTION OF THE DRAWINGS

Figure 7:
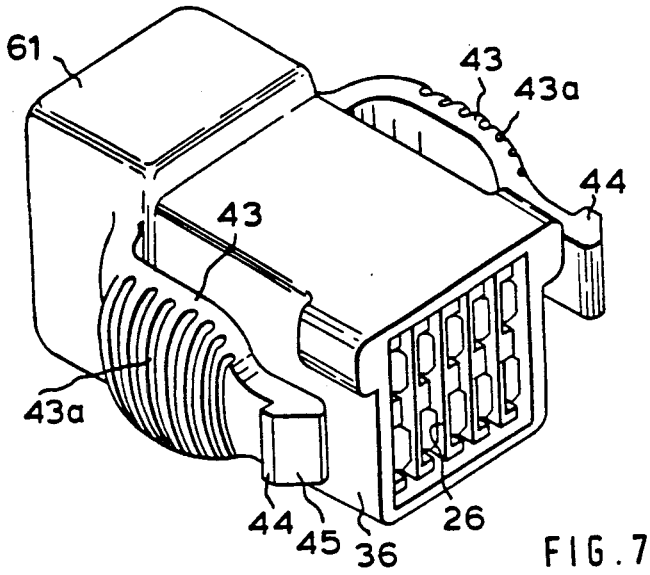
FIG. 7 is a perspective view of a male housing to co-operate with the female housing shown in FIG. 5.

Turning first to FIG. 1, a modular body 1 is shown as having two contact locating grooves 2*a* and 2*b*. Each of these grooves is provided with a widened portion or extension 3. The grooves 2*a* and 2*b* extend for approximately half the thickness of the body 1, and in the region of the groove 2*a* there is provided a contact isolation arrangement comprising a transverse wall 4 and a laterally offset wall 5.

A slot 6 in the body 1 defines a flexible and resilient finger portion 7 of the body 1, which terminates in a head 8 of the same width as the body and having a pair of ramps or cam surfaces 8*a* (see also FIG. 3).

It will also be seen from FIG. 1 that a contact 11 is receivable within either groove 2*a* or 2*b*, and normally a similar contact would be provided in each of these grooves. The contact 11 is shown as being provided with an offset or joggle 12 which cooperates with the widened portion or extension 3 of the groove to prevent longitudinal movement of the contact within the groove. It will be appreciated that in FIG. 1 the contact is shown somewhat truncated, and by reference to FIG. 4, it can be seen that one end of the contact, i.e. the end of the contact on the side of the head 8, is crimped to a respective wire 14. The contacts illustrated are of the type known as cantilever beam contacts.

In FIG. 2, a housing is illustrated at 16 and can be seen as having a number of ribs 17 on one internal face thereof to provide guide tracks for receipt of bodies 1 so that a number of bodies 1 can be individually slid into spaced parallel positions using the guide tracks. Diagrammatically shown above the guide tracks is a further guide 18 for the body, and this is shown as having a tab 19 for co-operation with the ramp 8*a*. When the body 1 is introduced into the housing 16, the spring finger 7 is deflected by tab 19. FIG. 7 snaps back on full engagement, so that the head 8 engages behind the tab 19 as indicated in FIG. 4, locking the body 1 into place.

FIG. 3 illustrates a number of bodies 1 arranged side by side within the housing 16, closely juxtaposed to one another so as to prevent movement of the contacts 11 out of their respective grooves. It will also be seen that the walls 4 isolate the two contacts in the same body from each other, whereas the offset walls 5 isolate the contacts from contacts in adjacent bodies 1.

It will be appreciated that in use, mating male and female housings are provided. The same form of body 1 may be used in either. The bodies 1 are inserted the opposite way up in the male housing with respect to the position shown in FIGS. 3 and 4, so that the walls 5 do not interfere with each other, but provide a contact isolating function in relation to the grooves 2*b* when the two types of housing are brought together.

It will be seen from the above that the arrangement is simple to assemble in that the contacts 11 are introduced into the respective bodies 1 by simple sideways movement and cannot be then longitudinally shifted within their grooves 2*a* or 2*b*. Once the modules are assembled in the housings, the contacts are incapable of movement in any direction. Moreover, the asymmetric arrangement of the walls 4 and 5 enables the same bodies to be used for both male or female contacts in the housings.

It is preferred that identification should be included on the housing and on the module or body 1 to assist in correct insertion.

Turning now to FIGS. 5 to 7, illustrating a second embodiment of the invention, there is illustrated in FIG. 5 a female housing 21 having a group of generally identical modular bodies 22 in parallel positions therein. Grooves 21*a* are shown moulded into the housing 21 to improve grip thereon. FIG. 5 also shows one of the modular bodies 22 removed from the housing 21. It will be seen that this body 22 has a latching arm 23 which is generally similar to the latching arm 7 described above, although the ramps 23*a* are rather more gently inclined and longer. Also, the portion 23*b* between the ramps 23*a* has square sides to slide between square form barriers within the housing 21. The latching arm 23 cooperates with a matching formation (not shown) within the housing 21.

The body 22 has first and second contact-receiving grooves or recesses 24, and these grooves continue into extension recesses 25 bounded by an offset lateral wall 26. The extension recesses 25 and wall 26 are also visible on the bodies shown within the female housing 21.

Each groove 24 is provided with an abutment 27 (see also FIG. 6). The grooves 24 also widen out at the ends opposite the extensions 25 to form extension recesses 28 receiving an enlarged contact end 29 which is crimped over a lead 31.

It will be seen that the contact illustrated in FIG. 5 is formed of two leaves 32 and 33 which have divergent end portions 32*a* and 33*a* respectively, and form a zone of contact 35 from where the divergent ends commence.

The zone of contact 35 is resilient so that a leaf of a similar contact introduced longitudinally will be received and held in the zone of contact to provide good electrical contact. This is achieved automatically when a male housing 36 (see FIG. 7) is introduced into and united with the female housing 21.

The leaf 33 is provided with a slot or recess 37 which, as shown more particularly in FIG. 6, cooperates with the abutment 27 to prevent longitudinal movement of the contact in the slot. Further, the lower edge of the slot 37 is provided with a resilient tongue 38 which is somewhat deflected on introduction of the contact into the slot and bites into the lower surface of the abutment 27 to provide a degree of inhibition of removal of the contact in a lateral direction. Accordingly, the contact will not readily fall out of its body.

Figure 13:
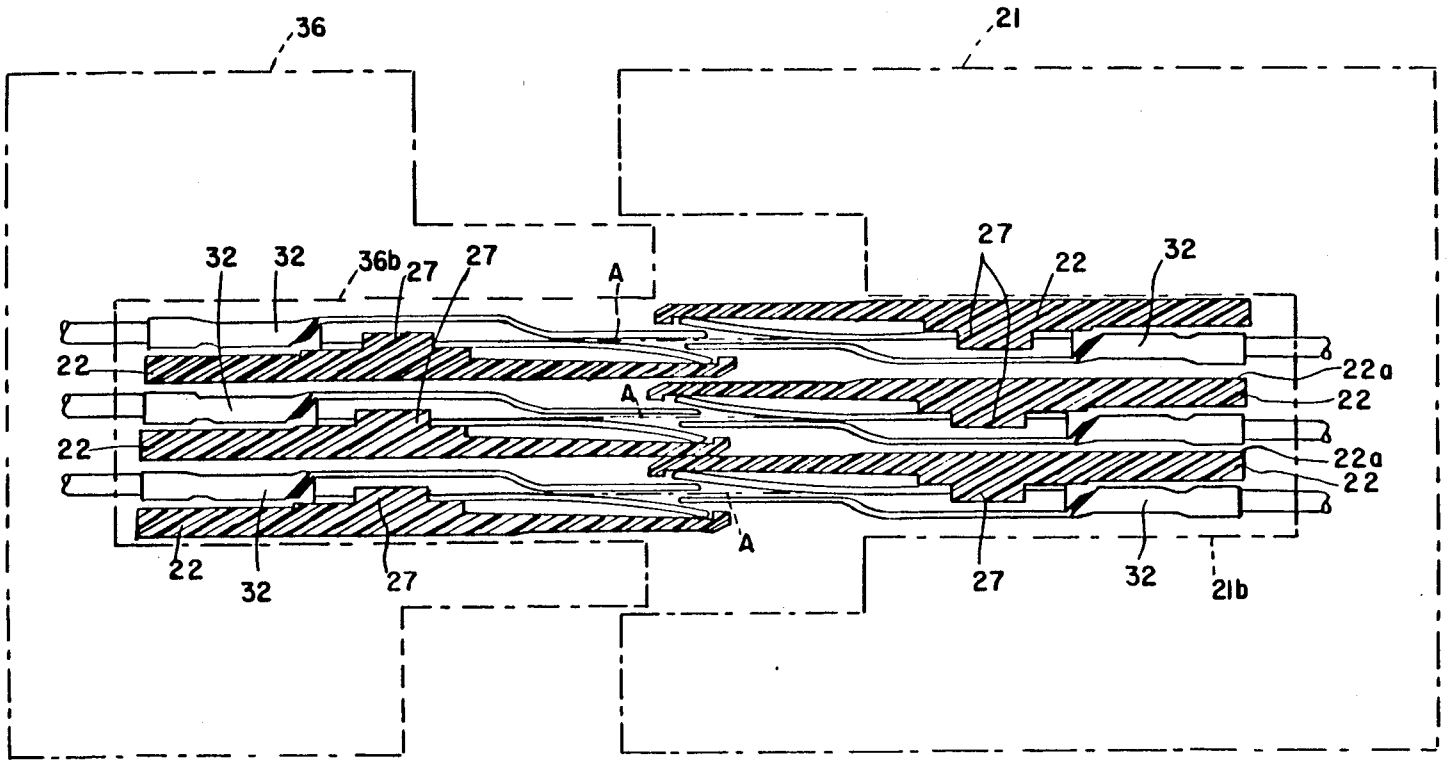
FIG. 13 is a cross-sectional view taken generally through the members shown in FIGS. 5 and 7, and shows schematically how the contact modules of the invention are employed in a hermaphroditic arrangement.

FIG. 13 shows schematically the assembly of three of the bodies 22 within a female housing 21 and their interaction with three corresponding bodies inserted within a male housing 36. As can be seen, the flat planar surfaces 22*a* of the bodies 22 which are juxtaposed to contacts 32 retain the contacts 32 in the grooves in the respective bodies 22; the inside wall 21*b* of the female housing 21 and the corresponding inside wall 36*b* of the male housing 36 retain the contacts in the grooves of the bodies 22 juxtaposed thereto.

The mating portions of the bodies 22 and the contacts 32, that is, the extension portions 25 and 26 and the contact leaves 35 and 33, are asymmetric about median axial planes A extending through the assemblies of the bodies 22 and the contacts 32, as illustrated in FIG. 13.

More particularly, it will be seen that the distal ends of the contact leaves are somewhat offset axially with respect to a median axial plane A of each body 22, as shown in FIG. 13, and the configuration of the wall 26 and extensions 25 is also axially offset, as may best be seen in FIG. 13 in respect of the bodies visible within the housing 21.

As shown best in FIG. 13, when a similar body 22 is introduced end-to-end and the same way up, i.e. with the latching arm 23 uppermost, it will be seen that the offsetting of the walls 26 and of the contacts 22 with respect to planes A enables the modules comprising bodies 22 and contacts 32 in the male housing 36 to be introduced between the similar modules in the female housing 21 so that the contacts meet and one leaf enters between the two leaves of the other contact. The contacts may thus be deemed to be hermaphroditic since it is not necessary to provide different types of male and female contact; instead a common design is used.

FIG. 5 also shows that the female housing is provided with lateral extensions 41 having recesses 42 which receive resilient arms 43 (see FIG. 7) on the male housing 36. These arms 43 are provided with latching lugs 44 having lead-in surfaces 45 to engage and snap over appropriate surfaces (not shown) arranged within each of the recesses 42. The two parts of the housing are thus releasably mated together, and the design is such that when the latching lugs 44 snap into position, the contacts in the various bodies 22 are in firm contact with their opposed contacts. The housing parts 21 and 36 may be readily released for separation by manual pressure on the arms 43. In order to improve manual engagement with the arms 43, they are provided with moulded-in grooves 43*a*.

The male housing 36 is shown in FIG. 7 as having an enlarged rear end 61, which is of the same overall dimensions as the rear of the female housing 21, thereby facilitating the use of a common form of sealing grommet (not shown) for splash-proofing of the housings.

FIG. 5 further shows a mounting device comprising a base 51 adapted to be attached to a panel or the like. The base 51 is provided with a pair of resilient arms 52 ending in latching lugs 53 with lead-in surfaces 54 and forming shoulders 55 to provide a snap fit when introduced between the extensions 41 and further extensions 56 located therebehind so as to form a slot 57 of substantially the width of the arms 52, and provided with an abutment or keeper surface which is just visible at 58.

Figure 8:
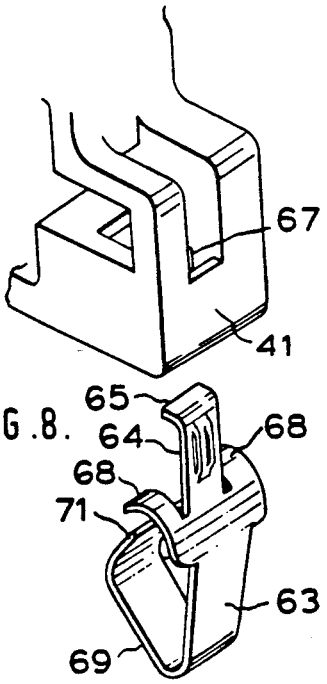
FIG. 8 shows a modified form of panel mounting device for a modified form of the housing of FIG. 5.

FIG. 8 shows part of a somewhat modified form of the female housing 21, in that the lateral extensions 41 are somewhat modified to co-operate with a different form of panel mounting. This figure shows one of a pair of pressed metal clips 63. Each clip 63 has an upstanding tongue 64 to enter a recess in the underside of the extension 41 and a turned-over end 65 to clip over an abutment 67 located within the extension 41. The lower end of the clip is formed in a compressible generally V form 69, with a turned in end 71, so as to be received and held in appropriately shaped holes in the panel to which the housing is to be mounted, and a pair of spring arms 68 engage the upper surface of the panel to hold the clip 63 in position under some spring tension to prevent rattling and to accommodate variations in panel thickness.

Figure 9:
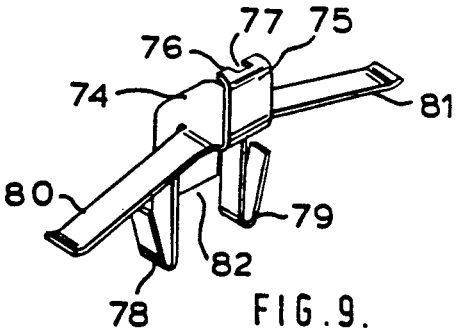
FIG. 9 is a view similar to part of FIG. 8, and showing an alternative form of clip.

FIG. 9 shows an alternative form of clip 74 to hold the housing onto a panel. The clip 74 has an upstanding tongue 75 with a turned-over end part 76 to clip over an abutment 67 located within the extension 41. The turned-over end part 76 is provided with a slot or cutaway 77 to facilitate withdrawal from the housing 21 when desired. A lower end of the clip 74 has a pair of spring legs 78 and 79 which each pass through an appropriately shaped aperture in the panel to which the housing is to be mounted and expand somewhat to retain the housing. Laterally extending spring arms 80 and 81 provide firm anchorage of the housing 21 into apertures in panels having a variety of different thicknesses. The clip 74 further comprises a down-turned tongue 82 located behind the spring legs 78 and 79 and adapted to enter a shaped aperture in the panel to engage the same mechanically to prevent axial movement of the housing 21, which movement might overstrain and damage the spring legs 78 and 79.

Figure 10:
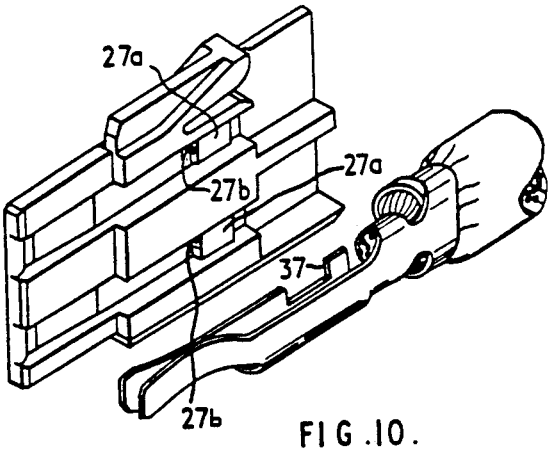
FIG. 10 is a view similar to part of FIG. 5 showing a modification.

Turning now to FIG. 10, this shows a modified form of retention for the contact (in the second embodiment of the invention as shown in FIGS. 5–7 and 13) by the abutment 27*a*. In this arrangement, the abutment 27*a* is of L section to provide an undercut 27*b* which receives and engages the lower edge of the slot 37 to hold the contact against lateral movement. In order to achieve this, the contact has to be introduced at an angle and twisted into its final position. Removal may also be effected by an initial twist to release the edge of the slot 37 from the undercut 27*b*. It will be noted that the tine or tongue 38 has been omitted.

Figure 11:
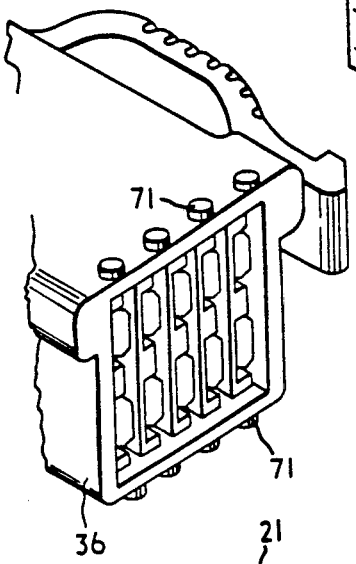
FIGS. 11 and 12 are views similar to parts of FIGS. 5 and 7 and showing a still further modification.
Figure 12:
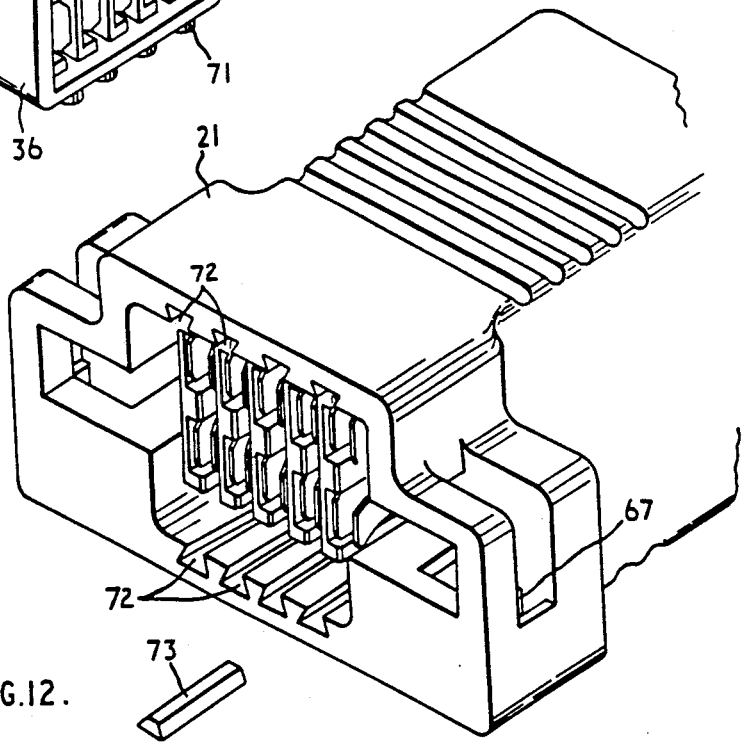

FIGS. 11 and 12 show an arrangement for inhibiting incorrect connection of housings by providing a user-definable code. It will be seen that the end of the male housing 36 is formed with a plurality, in the example given eight, of studs 71, while the end of the female housing 21 of FIG. 11 has a corresponding series of slots 72 to receive the studs 71. In use, the assembler will block two (or more or less) of the slots 72 with plugs 73, and will grind away or otherwise remove the corresponding studs 71 from the matching male housing 36. This enables correct matching to be made, but will inhibit mismatching between incorrect housings. It will be seen that a code defined by any two from eight will give twenty eight variations, while any three from eight will give fifty six possible combinations.

It will have been seen that FIGS. 5 to 8 show a number of modifications when compared with the arrangement of FIGS. 1 to 4, and it will be understood that for instance the contact isolation arrangements consisting of the walls 26 and extensions 25 may be used in conjunction with the contacts of the same general type as those shown in FIGS. 1 to 4.

Also, if required, the contacts of FIGS. 5, 6 and 10 may, with some modification, be used in conjunction with the isolation arrangements of FIGS. 1 to 4. Also, the mismatch inhibition arrangement of FIGS. 11 and 12 may be adapted for use with the housings of FIGS. 1 to 4.

Various other modifications may be made within the scope of the invention.

We claim:

1. A connector assembly, comprising:

a plurality of contacts;

a plurality of substantially identical bodies to be received in a housing, each of said bodies comprising at least one groove for receiving said contacts, each of said bodies having abutment means within said groove, said contacts having means for engaging said abutment means to prevent longitudinal motion of said contacts relative to said bodies and a surface on each said body adapted to abut the contacts located in grooves of an adjoining body so that said contact is retained laterally in the groove in said adjoining body when said bodies are received in said housing;

said housing comprising a plurality of grooves for receiving and retaining a plurality of said bodies in spaced parallel relation; and resilient means associated with each of said bodies and latch means associated with said housing, said resilient means and said latch means cooperating to retain said bodies within said housing.

* * * * *